US007151461B2

(12) United States Patent
Wilson et al.

(10) Patent No.: US 7,151,461 B2
(45) Date of Patent: Dec. 19, 2006

(54) MAGNETIC CONTACT TAMPER SWITCH FOR SECURITY ACCESSORIES

(75) Inventors: George N. Wilson, Maspeth, NY (US); Robert E. Lee, Garden City, NY (US); Kevin G. Piel, Ronkonkoma, NY (US)

(73) Assignee: Honeywell International, Inc., Morristown, NJ (US)

( * ) Notice: Subject to any disclaimer, the term of this patent is extended or adjusted under 35 U.S.C. 154(b) by 138 days.

(21) Appl. No.: 10/977,691

(22) Filed: Oct. 29, 2004

(65) Prior Publication Data

US 2006/0092020 A1 May 4, 2006

(51) Int. Cl.
*G08B 21/00* (2006.01)

(52) U.S. Cl. ..... 340/644; 340/545.2; 340/547; 200/61.45 M; 335/205; 335/207; 116/203

(58) Field of Classification Search ..... 340/644, 340/651, 652, 653, 655, 687, 545.2, 547; 200/61.45 M, 404, 468; 335/207, 205; 116/203
See application file for complete search history.

(56) References Cited

U.S. PATENT DOCUMENTS 4,296,394 A * 10/1981 Ragheb ..... 335/207
4,982,684 A * 1/1991 Rubey ..... 116/203
5,483,214 A * 1/1996 Perreira et al. ..... 335/205
5,945,915 A 8/1999 Cromer et al. ..... 340/686.1
6,642,824 B1 * 11/2003 Oomkes ..... 335/207

* cited by examiner

*Primary Examiner*—Van T. Trieu
(74) *Attorney, Agent, or Firm*—Scully, Scott, Murphy & Presser, P.C.

(57) ABSTRACT

A tamper detection switch is primarily for use in an enclosure of a security system component. The enclosure has a base and a cover that may be repositioned relative to the base. One of the cover and the base holds a conductive magnetic element free to translate within a predetermined range generally perpendicular to the respective cover or base. The other of the cover and the base holds at least two ferrous metal contacts of an open tamper circuit in proximity of a conductive magnetic element. In the closed position the conductive magnetic element bridges the ferrous contacts and closes the tamper circuit. Attempts to tamper with the enclosure separate the ferrous contacts from the conductive magnetic element, opening the tamper circuit and signaling a possible attack.

24 Claims, 1 Drawing Sheet

MAGNETIC CONTACT TAMPER SWITCH FOR SECURITY ACCESSORIES

BACKGROUND OF THE INVENTION

1. Field of Invention

The invention relates to the field of security systems, and more particularly to a contact tamper switch for detecting attempts to tamper with components of a security system.

2. Description of Related Art

In the field of security systems it is known to provide some means to detect attempts to tamper with the system, for example as an attempt to disable or defeat it. In particular, unauthorized access to system components may be presumed as attacks on the system. In particular, components of the security system may be accessible by potential intruders while the security system is in an unarmed state. As an example, the system component may be located in a room open to the public during normal hours, while the security system is unarmed.

In one embodiment, a circuit board, for example a printed circuit board (PCB), as an element of a security system component, is provided with a pressure-sensitive switch. A cover or enclosure of the security system component can act on the switch when the cover or enclosure is closed. Alternately or additionally, a pressure-sensitive switch may act on the surface the security system component is mounted to. Opening the cover or enclosure, and/or removing the system component from the surface it is mounted to, releases the pressure on the switch, which then changes state to indicate the presumed attack.

This approach has certain drawbacks, however. Among these is the localized pressure on the switch causing uneven stress in the PCB and/or the enclosure or cover. This may lead to fracture or failure with repeated opening and closing of the switch, cover, and/or enclosure. Alternately, the material of the enclosure, for example plastic, may deform or 'creep' due to long term closure of the switch. Accordingly, the pressure sensitive switch may no longer be reliably closed due to the material creep. Additionally, the surface to which the system component is mounted may be uneven, and not provide a reliable surface to actuate the pressure sensitive switch.

An alternate tamper detection means comprises a reed switch and magnet arrangement. The reed switch changes state in proximity of the magnet, and the two are located in proximity with one another when the component is mounted to the wall and/or the cover or enclosure are closed. When the moved away from the magnet, typically by opening the cover or enclosure, the reed switch changes state to indicate the presumed attack. At least one drawback of this arrangement is the vulnerability of the reed switch. If a larger magnetic field with the proper polar orientation is placed in the vicinity of the reed switch, the reed switch will not detect loss of proximity with the magnet, which indicates the component may have been disturbed as part of a presumed attack.

BRIEF SUMMARY OF THE INVENTION

Therefore, in order to overcome these and other drawbacks in the prior art, an improved tamper detection switch is desirable. Provided according to the present invention is a tamper detection switch, disclosed primarily for use in an enclosure of a security system component. The enclosure has a base and a cover that may be repositioned relative to the base. One of the cover and the base holds a conductive magnetic element free to translate within a predetermined range generally perpendicular to the respective cover or base. The other of the cover and the base holds at least two ferrous metal contacts of an open tamper circuit in proximity of a conductive magnetic element. In the closed position the conductive magnetic element bridges the ferrous contacts and closes the tamper circuit. Attempts to tamper with the enclosure separate the ferrous contacts from the conductive magnetic element, opening the tamper circuit and signaling a possible attack.

In further refined embodiments, the conductive magnetic element comprises one of a ferrous metal and an electromagnet, either in the shape of a cylindrical disk or a torus. In yet a further embodiment, the cover and base are secured to one another by one or more of a fastener, a snap fit, a friction fit, a mechanical hinge, a living hinge, or other means.

In further embodiments, the ferrous contacts may be mounted on a circuit board, the circuit board being positioned by the cover in its closed position to locate the two ferrous contacts in proximity of the base. The ferrous contacts may be secured to a cover by a snap fit, fastener, adhesive, solvents, friction fit, or other means. In yet a further embodiment, the base comprises a cage separable from the base, the conductive magnetic element being captured by the cage.

BRIEF DESCRIPTION OF THE DRAWINGS

These and other features, benefits and advantages of the present invention will be made apparent with reference to the following specification and accompanying figures, wherein like reference numerals refer to like structures across the several views, and wherein.

DETAILED DESCRIPTION OF THE INVENTION

Figure 1A:
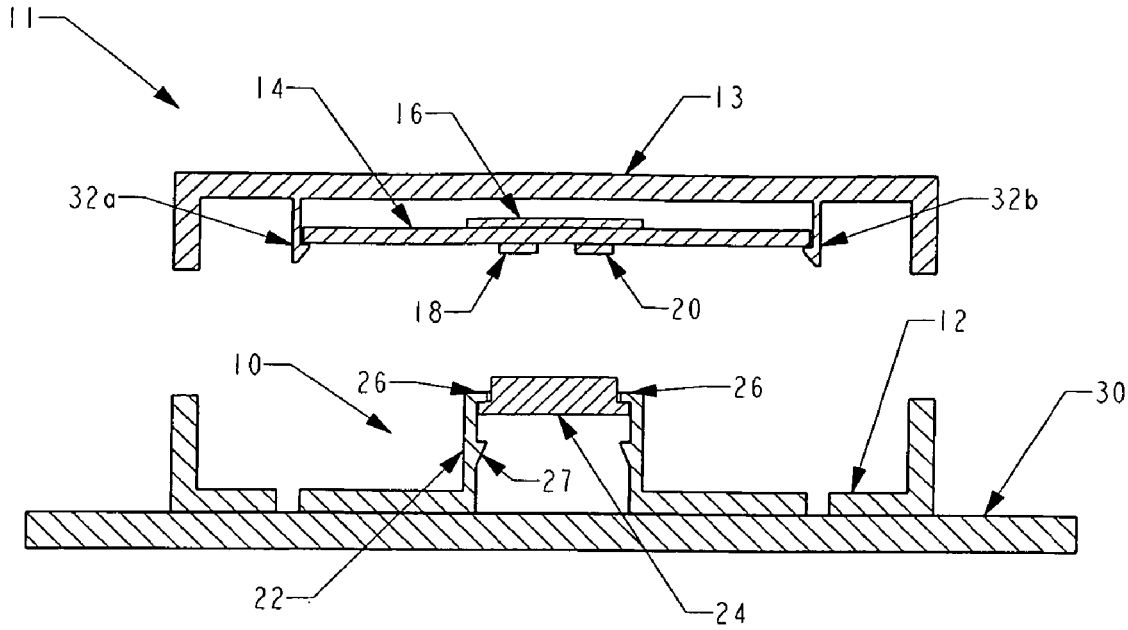
FIGS. 1A and 1B illustrate a cross-sectional view of the enclosure of a security system component having a contact tamper switch according to an exemplary embodiment of the present invention, in open and closed states, respectively.

Referring now to FIG. 1A, illustrated in cross-section is a magnetic contact tamper switch, generally 10, in an open condition. The component 11 to be protected by the tamper switch 10 includes a base 12, a cover 13, and a circuit board 14. The component 11 may be closed (see FIG. 1B), by fixing cover 13 on base 12 for example by a fastener, friction fit, snap fit, or a mechanical or living hinge (none shown). In the closed position, the circuit board 14 is positioned between the base 12 and the cover 13. Optionally, the circuit board 14 may be secured to the cover 13, for example by snap fit projections 32*a*, 32*b*. Alternately, fasteners, adhesive, solvents, friction fits, or similar means known in the art may be employed to secure the circuit board 14 to the cover 13.

The circuit board 14 includes a tamper detection circuit 16. The tamper detection circuit 16 is open between two ferrous contacts, 18, 20. In this context, ferrous contacts shall include contacts comprising a ferrous material as at least part therefore, for example ranging from ferrous material throughout to merely as a coating. Ferrous contacts 18, 20 are provided extending at least from a side of the circuit board 16 facing the base 12. In alternate embodiments, the tamper detection circuit may be located elsewhere in the component 11, or elsewhere in the security system generally, provided it is in communication with the ferrous contacts 18, 20. Additionally, one skilled in the art will recognize that the circuit board 14 itself is not essential, and any structure suitable to hold the ferrous contacts 18, 20 will suffice.

Base 12 includes a cage 22 for holding a conductive magnetic element 24. Cage 22 may be integral with the base 12, or as illustrated in the Figures, it may be a separable component independently mounted to the underlying surface 30. The conductive magnetic element may include a ferrous material having relatively low resistivity, or an electromagnet, similarly having low resistivity. Alternately or additionally, the conductive magnetic element may comprise one of a variety of low conductivity magnetic rare earth metals, ceramic, or alloy of aluminum, nickel and cobalt (sometimes termed 'alnico'), to which a conductive, e.g., metallic, coating or plating is applied. Though many shapes of conductive magnetic element 24 are acceptable, in the exemplary embodiment it is cylindrical, as a disk or a torus. The cage 22 can by generally in the shape of the conductive magnetic element 24, or at least operative to prevent significant lateral movement or tilting of the conductive magnetic element 24. The conductive magnetic element 24 is free to move perpendicular to the base 12 and/or the circuit board 14, within a range permitted by stops 26. Additionally, stops 27 may be provided beneath the conductive magnetic element 24 to limit its downward axial movement. Alternately, if convenient with the mounting of the circuit board 14, the cage 22 may have a lower height dimension such that stops 27 are unnecessary in view of the underlying surface 30. Even so, they may still be provided for convenience in manufacturing and installation.

The operation of the magnetic contact tamper switch will now be described. FIG. 1A illustrates the tamper switch 10 in an open state. When a system component 11 is closed, the circuit board 14 is brought against the base 12, and cage 22, by the cover 13. As the ferrous contacts 18, 20 are placed in the vicinity of conductive magnetic element 24, the magnetic element 24 is attracted to the contacts 18, 20. Engaging both ferrous contacts 18, 20, the conductive magnetic element 24 completes the tamper circuit 16.

Figure 1B:
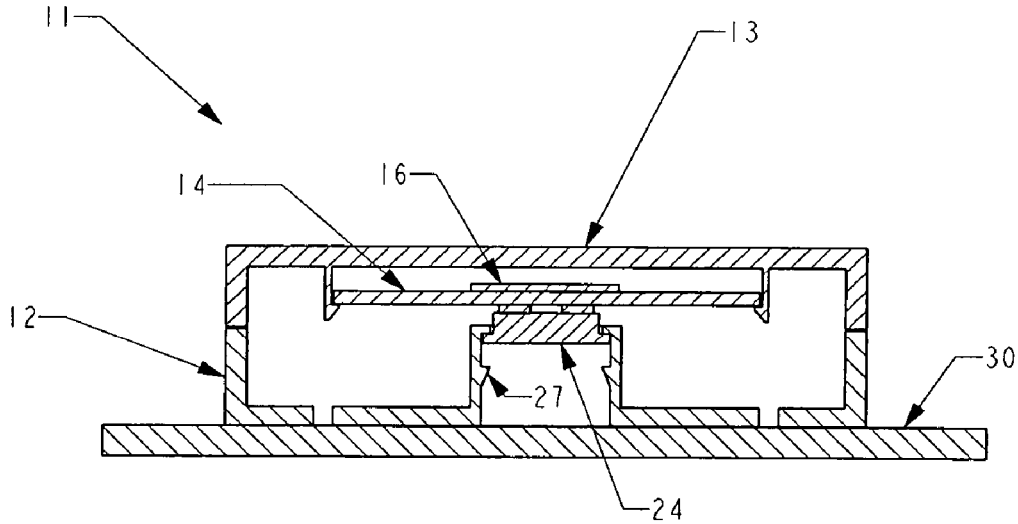

Referring now to FIG. 1B, illustrated in cross-section is a magnetic contact tamper switch 10 in a closed condition. Thereafter, any attempt to remove the cover 13 from the base 12 would separate the ferrous contacts 18, 20 from the conductive magnetic element 24, which is restrained by stops 26. This would be either because the cover 13 no longer holds the circuit board 14 in place, and if mounted vertically or inverted, the circuit board 14 would fall away under its own weight. Alternately, as in the embodiment shown where the circuit board 14 is secured to the cover 13, the two move unitarily away from the conductive magnetic element 24 as the cover 13 is opened. In the former case, it is preferable that the magnetic strength of the conductive magnetic element 24 is such that the weight of the circuit is sufficient to break the magnetic attraction of the conductive magnetic element 24 with the cover 13 removed. Therefore, the tamper circuit 16 would be opened, which could be detected and interpreted as a likely attack on the component 11, and/or the overall security system.

Additional protection is provided where, as in the illustrated embodiment, the cage 22 is separate from the base 12 and independently mounted to the underlying surface 30. In that case, where an intruder were to attack by attempting to remove the base 12 from the underlying surface 30, the cage 22, and consequently the magnetic element 24, would remain secured to the surface 30, and the tamper circuit 16 would be broken, indicating a potential attack.

In an alternate embodiment, the magnetic tamper switch 10 may be mounted within the component 11 in an inverted fashion. That is, the cage 22 and conductive magnetic element 24 may be provided on a cover 13, while the tamper switch are held by the base 12.

The present invention has been described herein with reference to certain exemplary and/or preferred embodiments. Certain alterations or modification may be apparent to those skilled in the art, in light of the present disclosure, without departing from the scope of the invention. These embodiments are meant to be illustrative, and not limiting, on the scope of the present invention, which is defined with reference to the appended claims.

The invention claimed is:

1. A magnetic contact tamper switch for use in security components, the switch comprising:

an enclosure having a base and a cover, the cover able to be repositioned with respect to the base, the cover having an open position and a closed position;

a tamper circuit being open between two ferrous contacts, the two ferrous contacts being located in proximity of the base by the cover in its closed position; and a conductive magnetic element sized to bridge the two ferrous contacts captured within the enclosure adjacent to the base.

2. The magnetic contact tamper switch according to claim 1 wherein the conductive magnetic element comprises a ferrous metal.

3. The magnetic contact tamper switch according to claim 1 wherein the conductive magnetic element comprises an electromagnet.

4. The magnetic contact tamper switch according to claim 1 wherein the conductive magnetic element comprises one or more of a rare earth metal, a ceramic, or an alloy of aluminum nickel and cobalt, said conductive magnetic element further having a conductive coating.

5. The magnetic contact tamper switch according to claim 1 wherein the conductive magnetic element comprises one of a cylindrical disk and a torus.

6. The magnetic contact tamper switch according to claim 1 wherein the cover and base are secured to one another by one or more of a fastener, a snap fit, a friction fit, a mechanical hinge, a living hinge, and a means for securing the cover and the base to one another.

7. The magnetic contact tamper switch according to claim 1 wherein the two ferrous contacts are mounted on a circuit board, the circuit board being positioned by the cover in its closed position to locate the two ferrous contacts in proximity of the base.

8. The magnetic contact tamper switch according to claim 1 wherein the tamper circuit is secured to a cover by one or more of a snap fit, fastener, adhesive, solvents, friction fits, or means for securing the tamper circuit to the cover.

9. The magnetic contact tamper switch according to claim 1 wherein the base comprises a cage separable from the base, the conductive magnetic element being captured by the cage.

10. A magnetic contact tamper switch for use in security components, the switch comprising:

an enclosure;

a circuit board;

a tamper detection means on the circuit board, the tamper detection means including two ferrous contacts; and a conductive magnetic means for bridging the two ferrous contacts;

means for holding the conductive magnetic means adjacent to the ferrous contacts, the conductive magnetic means being free to translate perpendicular to the plane of the circuit board.

11. The magnetic contact tamper switch according to claim 10 wherein the enclosure comprises a cover and a base, the cover able to be repositioned with respect to the base.

12. The magnetic contact tamper switch according to claim 10 wherein the cover and the base are secured to one another by one or more of a fastener, a snap fit, a friction fit, a mechanical hinge, a living hinge, and a means for securing the cover and the base to one another.

13. The magnetic contact tamper switch according to claim 11 wherein the tamper detection means is secured to a cover by one or more of a snap fit, fastener, adhesive, solvents, friction fits, or means for securing the tamper circuit to the cover.

14. The magnetic contact tamper switch according to claim 11 wherein the base comprises a cage separable from the base, the conductive magnetic means being captured by the cage.

15. The magnetic contact tamper switch according to claim 10 wherein the tamper detection means is mounted on a circuit board, the circuit board being positioned to locate the two ferrous contacts in proximity of the base.

16. An enclosure for a security system having a tamper detection switch, the enclosure comprising:

a base;

a cover which may be repositioned relative to the base;

one of the cover and the base holding a conductive magnetic element free to translate within a predetermined range generally perpendicular to the respective cover or base; and the other of the cover and the base holding two ferrous metal contacts of an open tamper circuit in proximity of a conductive magnetic element.

17. The magnetic contact tamper switch according to claim 16 wherein the conductive magnetic element comprises a ferrous metal.

18. The magnetic contact tamper switch according to claim 16 wherein the conductive magnetic element comprises an electromagnet.

19. The magnetic contact tamper switch according to claim 16 wherein the conductive magnetic element comprises a rare earth metal, a ceramic, or an alloy of aluminum nickel and cobalt, said conductive magnetic element further having a conductive coating.

20. The magnetic contact tamper switch according to claim 16 wherein the conductive magnetic element comprises one of a cylindrical disk and a torus.

21. The magnetic contact tamper switch according to claim 16 wherein the cover and base are secured to one another by one or more of a fastener, a snap fit, a friction fit, a mechanical hinge, a living hinge, and a means for securing the cover and the base to one another.

22. The magnetic contact tamper switch according to claim 16 wherein the tamper circuit is mounted on a circuit board, the circuit board being positioned by the cover in its closed position to locate the two ferrous contacts in proximity of the base.

23. The magnetic contact tamper switch according to claim 16 wherein the two ferrous metal contacts are secured to the cover by one or more of a snap fit, fastener, adhesive, solvents, friction fits, or means for securing the tamper circuit to the cover.

24. The magnetic contact tamper switch according to claim 16 wherein one of the cover and the base holding a conductive magnetic element comprises a cage separable from the respective cover or base, the conductive magnetic element being captured by the cage.

* * * * *